United States Patent [19]

Langenhahn et al.

[11] Patent Number: 4,830,068

[45] Date of Patent: May 16, 1989

[54] DEVICE FOR THE SIMULTANEOUS QUANTITATIVE REGULATED FILLING OF LIQUID OR SOFT PLASTICIZED SUBSTANCES, SUCH AS BUTTER, MARGARINE, PASTES OR THE LIKE BY MEANS OF NOZZLES INTO ADJACENTLY ARRANGED CONTAINERS

[75] Inventors: Lutz Langenhahn, Ettlingen; Alfred Mooshammer, Ratingen; Georg Fischer, Velbert, all of Fed. Rep. of Germany

[73] Assignee: Benz & Hilgers GmbH, Duesseldorf, Fed. Rep. of Germany

[21] Appl. No.: 92,002

[22] Filed: Sep. 2, 1987

[30] Foreign Application Priority Data

Sep. 4, 1986 [DE] Fed. Rep. of Germany ..... 3630077

[51] Int. Cl.[4] ..... B67C 3/28

[52] U.S. Cl. ..... 141/266; 141/258; 141/243; 141/237; 141/83; 222/485

[58] Field of Search ..... 222/485, 484; 141/258, 141/259, 260, 255, 251, 266, 237, 238, 240, 241, 244, 83

[56] References Cited

U.S. PATENT DOCUMENTS

| | | | |
|---|---|---|---|
| 2,103,817 | 12/1987 | Johnson | 141/255 X |
| 2,182,093 | 12/1939 | Peltz | 141/237 X |
| 2,412,026 | 12/1946 | Adams | 141/237 X |
| 3,999,691 | 12/1976 | Doom | 141/244 X |
| 4,039,062 | 8/1977 | Carré et al. | 222/485 X |
| 4,206,857 | 6/1980 | Gregory et al. | 222/485 X |
| 4,373,560 | 2/1983 | Elsworth | 141/129 |
| 4,456,154 | 6/1984 | Herriman | 222/484 X |
| 4,582,101 | 4/1986 | Graffin | 141/83 |
| 4,635,688 | 1/1987 | Graffin | 141/83 X |
| 4,667,709 | 5/1987 | Fischer et al. | 141/258 X |

FOREIGN PATENT DOCUMENTS

| | | |
|---|---|---|
| 0185958 | 11/1985 | European Pat. Off. . |
| 2123212 | 11/1972 | Fed. Rep. of Germany . |
| 2057424 | 10/1976 | Fed. Rep. of Germany . |

*Primary Examiner*—Ernest G. Cusick
*Attorney, Agent, or Firm*—Klein & Vibber

[57] ABSTRACT

A device for the simultaneous quantitative regulated filling of liquid or soft plasticized substances, such as butter, margarine, pastes or the like, by means of nozzles into adjacently arranged containers with the assistance of at least one control element interchangeably switchable from filling to discharging and at least one dosing piston. The device is arranged in such a way that two adjacent nozzles arranged in tandem are assigned one control element and one dosing piston. A passageway in the transition region from the actual dosing device to the nozzles can be adjusted preferably by means of a regulating valve whose angle of rotation can be altered. This regulating valve provides for an especially delicately sensitive and precise distribution of the product stream onto the one or the other nozzle for the purpose of balancing the output volume.

10 Claims, 4 Drawing Sheets

FIG. 2
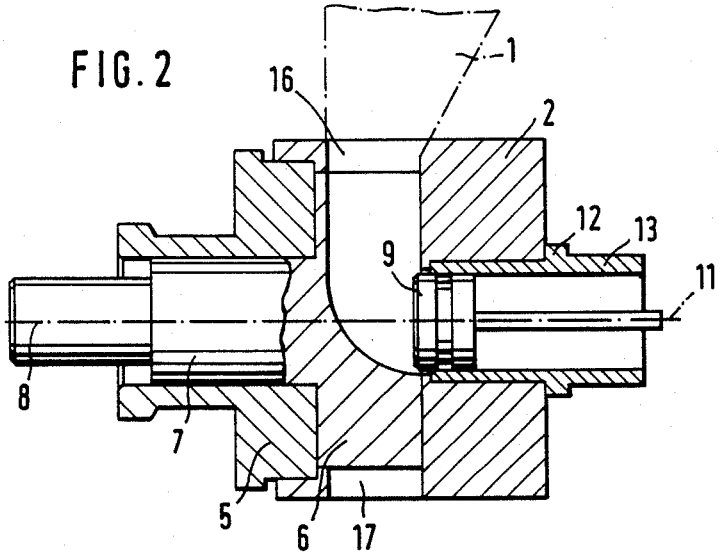
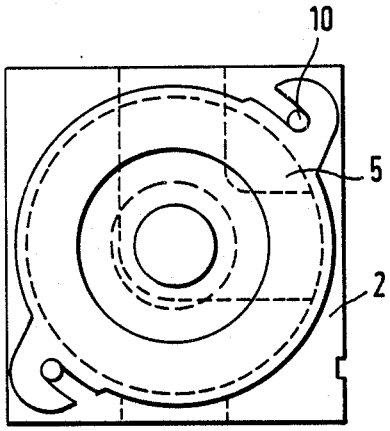
FIG. 3

DEVICE FOR THE SIMULTANEOUS QUANTITATIVE REGULATED FILLING OF LIQUID OR SOFT PLASTICIZED SUBSTANCES, SUCH AS BUTTER, MARGARINE, PASTES OR THE LIKE BY MEANS OF NOZZLES INTO ADJACENTLY ARRANGED CONTAINERS

FIELD OF THE INVENTION

The invention relates to a device designed for the simultaneous quantitative regulated filling of liquid or soft plasticized substances, such as butter, margarine, pastes or the like by means of nozzles into adjacently arranged containers.

DESCRIPTION OF THE PRIOR ART

A known dosing device is disclosed in the West German Pat. No. 20 56 424. In the known dosing device, a revolving cylinder constructed as a control element is assigned two identically constructed passages each creating a connection between inlet and outlet openings. Both passages are arranged parallel to one another and eccentrically arranged in a plane vertical to the axis of rotation of the revolving cylinder. Both passages have dosing pistons joined together by crossbolts driven by a common piston rod, such that adjacent containers standing one behind the other can be filled with the product that is to be dispensed. The dosage volume is directly adjustable by means of a very cumbersome control gear from zero to a certain amount. This results in considerable structural waste. There is also structural waste in that the whole housing of the device must be arranged to be movable relative to the rigidly placed feed pipe. This not only requires special guideways, but also seals between the parts moving relative to one another. Thus the known device is accessible only with difficulty, and the individual structural elements are difficult and expensive to disassemble. Furthermore, cleaning, in particular continuous flow cleaning, is only possible in conjunction with considerable expenditure.

SUMMARY OF THE INVENTION

The invention addresses the problem of creating a device suitable for the simultaneous quantitative regulated filling of liquid or soft plasticized products, such as butter, margarine, pastes or the like, of the type mentioned above, which distinguishes itself through its very simple structural elements, its very good accessibility, as well as its easy cleaning possibilities. The inventive device comprises two nozzles arranged in tandem, a control element and a dosing piston. A bearing housing containing the control element has an outlet opening through which substances are ejected into the nozzles. A passageway in the transition region between the control element and the outlet opening of the bearing housing, or the inlet opening of the nozzles, can be changed relative to its cross section. The means of the invention provide one, in a surprisingly simple method, with the possibility of conducting precise dosage filling accurately over the complete width of a machine. The cross section of the opening in the transition region between the control element and the nozzles is changed so that, depending upon requirements, one or the other nozzle can be supplied with a larger or smaller product amount. The inventive solution requires only one control element and one dosing piston for two adjacently positioned tracks. The changing or setting of the cross section of the passageway between the control element or bearing housing and the nozzles achieves the desired division [sectioning] of the product amount into the individual nozzles. The inventive device is distinctive in its very small number of structural elements. It is easily accessible and allows for very good cleaning, in particular CIP-cleaning.

In accordance with a preferred design embodiment of the invention, the control element is constructed as a regulating valve with an inlet passage and outlet passage. The regulating valve can be constructed as a rotary slide valve (distributing valve), whereby the cross section of its outlet passage essentially corresponds to the cross section of the inlet opening of the nozzles. A distribution of the product amount to be passed onto the nozzles is achieved via a change in the angle of rotation of the valve. In other words, the rotary slide valve, which can be moved back and forth by 90 degrees, is adjusted by plus or minus 2 degrees, i.e. 88 degrees or 92 degrees, in the discharge position. The cross section at the inlet of the nozzles can, thereby, be very specifically altered by means of this positive and negative change in the angle of rotation, effecting a division of the product amount onto the nozzles. The rotary slide valve is arranged in a revolving manner in a flange casing attached to the bearing housing. The dosing piston is axially slidably arranged in a liner attached to the bearing housing. The liner can be exchanged for differing product volumes. The attachment of the flange casing on the bearing housing can be achieved by means of a bayonet lock, allowing for simple mounting and removal.

A considerable simplification in manufacture is achieved when the axis of rotation of the rotary slide valve and the axis of the dosing piston are coaxially arranged with respect to one another.

The division of the product amount onto the adjacently arranged nozzles can also be achieved by a method whereby the nozzles are constructed as a unified structural element in the form of a twin nozzle. The inlet openings of the nozzles are adjustably arranged crosswise (at right angles) to the passage flow direction of the filling product. This can occur, for example, in the following way: the twin nozzle piece shows a central separating web in the region of its inlet opening, as well as diverging conduits running towards each other connected on both sides of said opening, and in continuation of said conduits essentially parallel running discharge passages. In this embodiment either the cross sections of the nozzles lying on both sides of the separating web can be changed, for example, with the assistance of adjusting ledges; or the separating web itself is adjustable crosswise to the passage flow direction of the filling product.

BRIEF DESCRIPTION OF THE DRAWING

A preferred embodiment of the invention is shown in the drawings and is more closely described in the following. They show:

FIG. 2: a longitudinal cross section of the dosing device, FIG. 3: a side view of the dosing device.

DESCRIPTION OF THE PREFERRED EMBODIMENT

Figure 1:
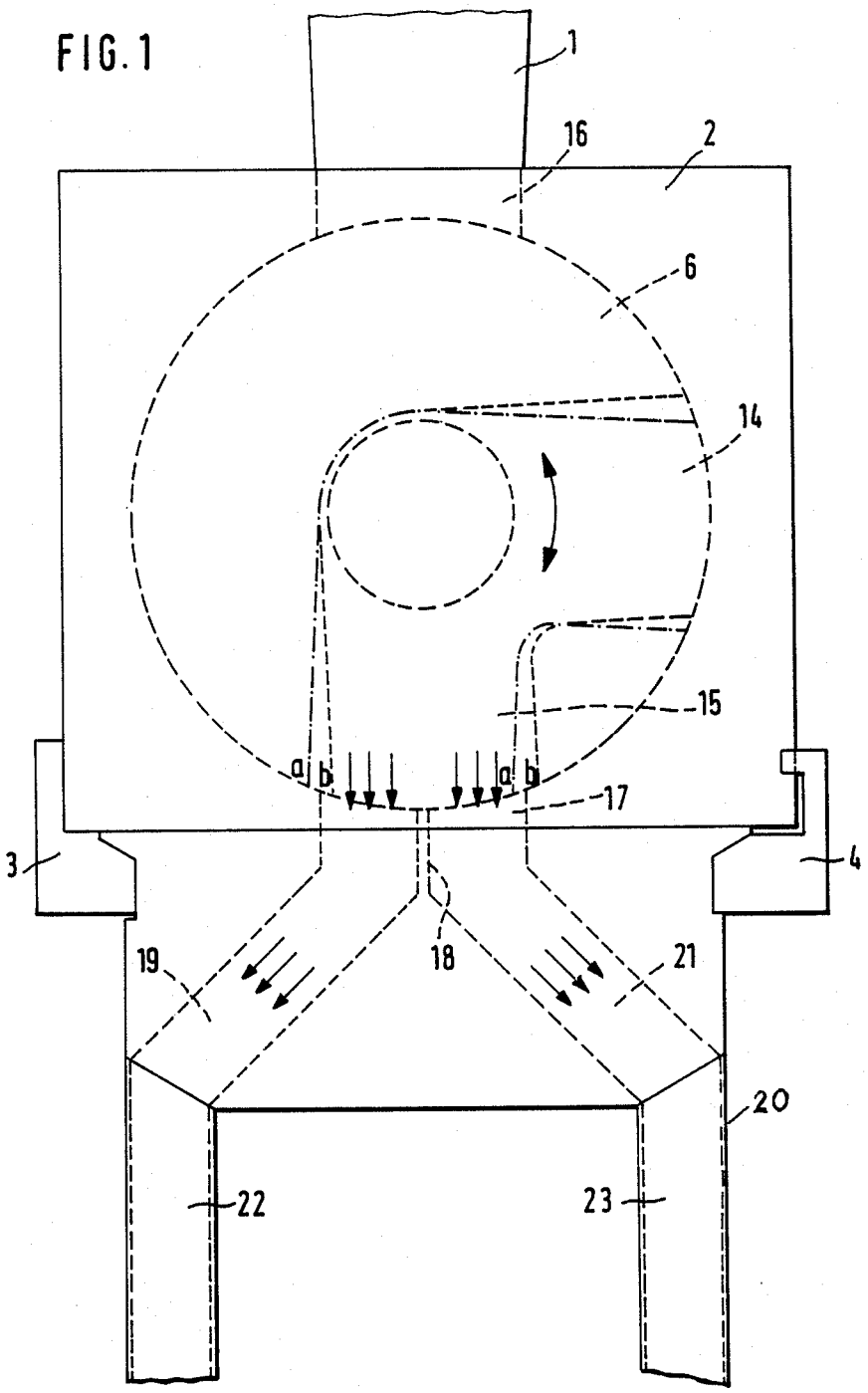
FIG. 1: a schematic illustration of a dosing device with a control element constructed as a regulating valve and nozzles in the form of a twin nozzle piece.

The inventive device shown in FIG. 1 is comprised of a filling funnel 1 above a bearing housing 2, said housing being capable of connection with the nozzles constructed as a twin nozzle piece 20 via a fixed connecting block 3 and a releasable connecting block 4.

As shown in FIGS. 2 and 3, a flange casing 5 can be fastened onto the bearing housing 2 by means of a bayonet lock 10. A control element in the form of a regulating valve 6 is rotatingly arranged in the flange casing 5 via a trunnion 7. The mechanism for driving the regulating valve is not shown. A dosing piston 9 is arranged on the opposite side of the flange casing and inside of the bearing housing 2 coaxial to the axis of rotation 8 of the regulating valve 6. The axis 11 of said piston is coincident with the axis of rotation 8. The dosing piston is axially slidably guided inside a liner 13 which is mounted on the bearing housing 2 via a stop 12.

Figure 5:
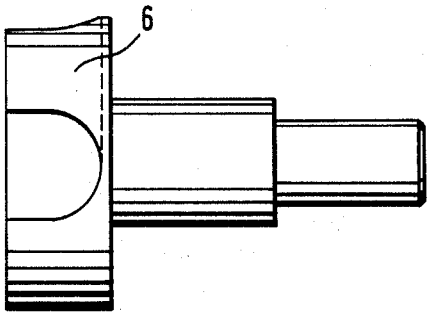
FIG. 5 is a side view of the regulating valve member.
Figure 4:
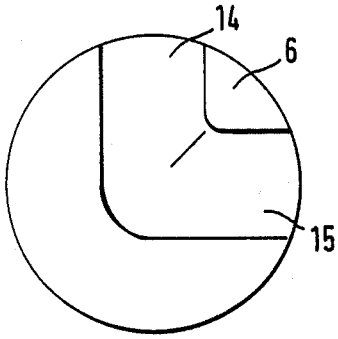
FIG. 4 is an end view of the regulating valve member.
Figure 6:
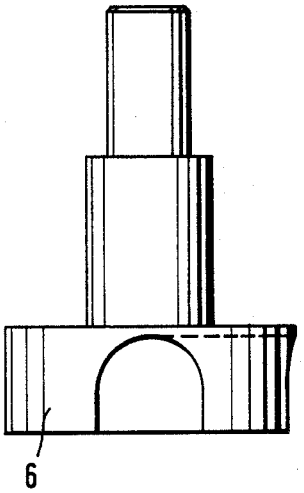
FIG. 6 is an elevational view of the regulating valve member.

As can be seen in detail from FIGS. 4, 5 and 6, the regulating valve 6 is comprised of an inlet passage 14 as well as an outlet passage 15, which operate, as is described in more detail below, in conjunction with an inlet opening 16 of the bearing housing 2 and an outlet opening 17 of the bearing housing 2.

The twin nozzle piece 20 contains a passageway in the transition region between the regulating valve 6 or outlet opening 17 and the twin nozzle piece 20. The cross section of said passageway is divided into two parts by a separating web 18. Diverging conduits 19 and 21 running towards each other and essentially parallel running discharge passages 22 and 23 are connected to this passageway.

The mode of operation of the dosing device is as follows: As shown in FIG. 1, the regulating valve 6 can be moved back and forth by at least 90 degrees so that the inlet passage 14 aligns with the inlet opening 16 of the bearing housing 2. The product present in the filling funnel 1 can be sucked into the valve by simultaneously retracting the dosing piston 9. Subsequently, the regulating valve 6 is rotated in a clockwise direction into one of the two positions a or b shown with dash-dotted and dashed lines, respectively. In such position the dosing piston 9 is advanced again, thereby effecting the ejection of the product and emission of the same via the conduits 19 and 21 and discharge passages 22 and 23 and filling adjacently placed containers with the product.

If it is determined that the product amount filled into one or the other row of filled containers reveals too low a weight factor, then compensation measures are required. This occurs in the following manner: either the position a or b is chosen via the corresponding change in the angle of rotation of the regulating valve 6 for a targeted product distribution into the conduits. It has been determined that very small changes in the angle, e.g. plus or minus 2 degrees, are necessary in order to assure a targeted distribution of the product for purposes of balancing the volume amount. Decisive in this regard is that the passageway in the transition region between the control element and the outlet opening be adjustable.

Figure 7:
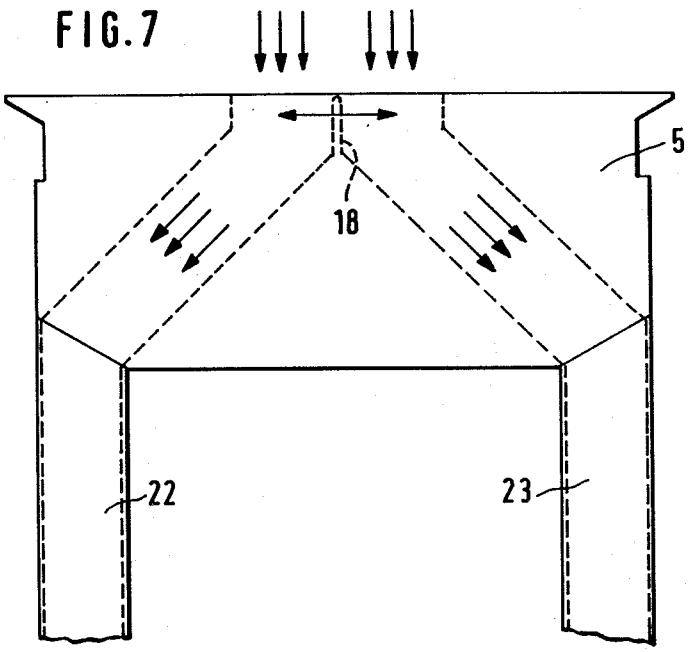
FIG. 7: the twin nozzle piece with an adjustable separating web.

The above adjustment can also occur directly at the twin nozzle piece 20. Instead of changing the rotation angle position of the regulating valve 6, the central separating web 18 can be adjusted crosswise to the passage flow direction of the filling product as is schematically shown in FIG. 7.

Figure 8:
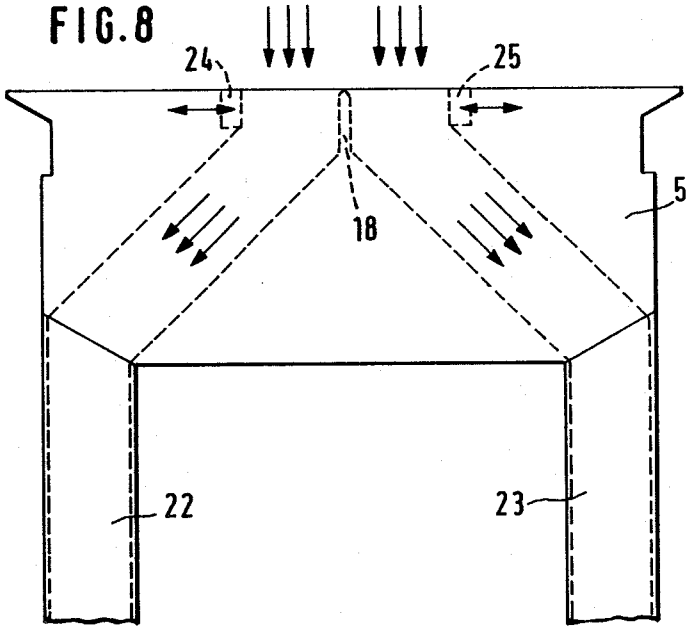
FIG. 8: a modified embodiment of the twin nozzle piece with adjusting ledges for cross sectional alteration of the product passageway.
Figure 9:
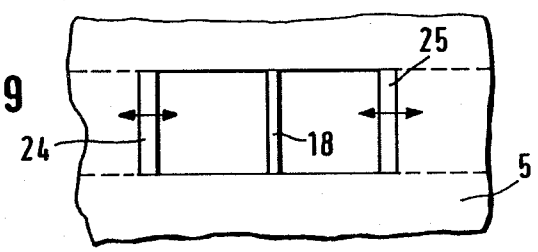
FIG. 9: a partial top view of the twin nozzle piece shown in FIG. 8.

A modified embodiment is shown in FIGS. 8 and 9 where the separating web 18 is in fixed position, however, the outer lateral boundary of the passageway cross section is adjustable, for example, by adjusting ledges 24 and 25 which can be independently adjusted. This allows for an optimal distribution of the product into the one or the other conduit 19 or 21 of the twin nozzle piece.

The product does not remain within the inlet or the outlet passage for an extended period of time, because of the relatively small dimensions of the regulating valve. Therefore, no clearance volumes are present which could cause serious problems.

It is to be expressly understood that the invention is in no way limited to the disclosure of the preferred embodiments, but is capable of modifications within the scope of the appended claims. Thus it is possible that the regulating valve can be utilized even when there is only one filling unit present, i.e. only one nozzle piece. No exchange of the regulating valve is required in such a case, thus, the dosing device according to the invention is universally employable.

We claim:

1. A device for the simultaneous quantitative regulated filling of liquid or soft plasticized substances, such as butter, margarine, pastes or the like by means of nozzles into adjacently arranged containers comprising a bearing housing with inlet and outlet openings and at least one control element rotatably mounted within the housing and being switchable between a filling position and a discharging position; at least one axially movable dosing piston coaxially slidably mounted with respect to said control element in a mating bore in said housing for suction and ejection of a predetermined amount of substance, wherein two adjacent nozzles arranged in tandem on said housing are assigned one control element and one dosing piston; the bearing housing comprising a passageway disposed between said at least one control element and the outlet opening of said housing and the inlet opening of the nozzles, and means operatively mounted in said housing for selectively changing the cross section of said passageway, whereby the amount of material to each of said adjacent nozzles can be adjusted.

2. A device as defined in claim 1, wherein the at least one control element is constructed as a regulating valve comprising an inlet passage and an outlet passage.

3. A device as defined in claim 2, wherein the regulating valve is constructed as a rotary slide valve whose outlet passage cross section essentially corresponds to the cross section of the inlet opening of the nozzles and a distribution of the product amount to be discharged into the nozzles is achieved by means of a change in the angle of rotation of the rotary slide valve.

4. A device as defined in claim 3, wherein the rotary slide valve is rotatingly arranged in a flange casing fastened onto the bearing housing and the at least one dosing piston is axially slidably arranged in a liner attachable to the bearing housing.

5. A device as defined in claim 4, wherein the axis of rotation of the rotary slide valve and the axis of the at least one dosing piston are coaxially arranged with respect to one another.

6. A device as defined in claim 5, wherein the axis of rotation of the rotary slide valve and the axis of the at least one dosing piston are arranged vertically above the nozzles.

7. A device as defined in claim 1, wherein the nozzles are constructed as a unified structural element in the form of a twin nozzle piece comprising an inlet opening arranged to be adjustable crosswise to the passage flow direction of the filling product.

8. A device as defined in claim 7, wherein the twin nozzle piece comprises a central separating web in the region of its inlet opening, as well as diverging conduits running towards each other connected on both sides of said inlet opening of the twin nozzle pace and in continuation of said conduits essentially parallel running discharge passages.

9. A device as defined in claim 8, wherein the cross sections of the twin nozzle piece lying on both sides of the separating web are adjustable by means of adjusting ledges.

10. A device as defined in claim 9, wherein the separating web is constructed to be adjustable crosswise to the passage flow direction of the filling product.

* * * * *